United States Patent [19]

Ekkelboom et al.

[11] Patent Number: 5,077,505

[45] Date of Patent: Dec. 31, 1991

[54] ELECTRIC LAMP AND SEAL STRUCTURE THEREFOR

[75] Inventors: Tjepke H. Ekkelboom; Adrianus J. A. Vermeulen, both of Eindhoven, Netherlands

[73] Assignee: U.S. Philips Corporation, New York, N.Y.

[21] Appl. No.: 553,480

[22] Filed: Jul. 13, 1990

[30] Foreign Application Priority Data

Jul. 24, 1989 [NL] Netherlands ..... 8901905

[51] Int. Cl.[5] ..... H01J 61/36; H01J 13/26

[52] U.S. Cl. ..... 313/623; 313/634; 313/331; 313/318

[58] Field of Search ..... 313/623, 332, 331, 318, 313/634; 174/50.61, 50.58

[56] References Cited

U.S. PATENT DOCUMENTS

| | | | |
|---|---|---|---|
| 2,114,869 | 4/1938 | Bol et al. | 174/50.61 |
| 2,617,068 | 11/1952 | Spinnler et al. | 313/623 X |
| 2,675,497 | 4/1954 | Meister et al. | 313/332 X |
| 3,448,320 | 6/1969 | Millikan | 313/331 X |
| 3,742,283 | 6/1973 | Loughridge | 174/50.61 X |
| 4,074,167 | 2/1978 | van den Broek et al. | 313/331 X |
| 4,171,500 | 10/1979 | Van Lieshout | 313/633 X |
| 4,282,395 | 8/1981 | Hagemann | 313/623 X |
| 4,691,142 | 9/1987 | Dohmen | 313/623 |

FOREIGN PATENT DOCUMENTS

| | | | |
|---|---|---|---|
| 952939 | 3/1964 | United Kingdom | 313/579 |

*Primary Examiner*—Palmer C. DeMeo

*Attorney, Agent, or Firm*—Robert J. Kraus

[57] ABSTRACT

The electric lamp has a quartz glass lamp vessel (1) with molybdenum current supply conductors (3) extending to an electric element (2) arranged in the lamp vesel (1). The current supply conductors (3) have a continuous coating (4) of quartz glass which is fused to the lamp vessel (1). The coating (4) forms with the current supply conductor (3) a glass/metal interface (5). The glass of the coating (4) adjoining the interface (5) contains thorium, hafnium, chromium, aluminum, titanium, tantalum, magnesium, calcium, strontium, barium, zirconium, lanthanum, scandium, a lanthanide, niobium, boron or yttrium. The coating (4) has a very strong adhesion to the metal; the lamp vessel (1) has a great strength.

7 Claims, 1 Drawing Sheet

ELECTRIC LAMP AND SEAL STRUCTURE THEREFOR

BACKGROUND OF THE INVENTION

The invention relates to an electric lamp comprising:

a lamp vessel sealed in a vacuum-tight manner and consisting of glass having an $SiO_2$ content of at least 95% by weight, an electric element arranged inside the lamp vessel, current supply conductors extending through the wall of the lamp vessel to the electric element, at least one current supply conductor made of molybdenum with a continuous coating of glass having an $SiO_2$ content of at least 95% by weight, which coating forms with the current supply conductor a glass/metal interface and is fused to the lamp vessel, while the surface of the coating encloses with the coated surface of the current supply conductor at the points at which they meet an angle $\alpha$.

Such a lamp is known from GB 602,215 (1948.5.21).

In substantially all types of electric lamps comprising a lamp vessel of glass having an $SiO_2$ content of at least 95% by weight, the current supply conductors are passed in a vacuum-tight manner through the wall of the lamp vessel in that the current supply conductors comprise a foil-shaped part of molybdenum which is embedded in a pinched seal of the lamp vessel. In this construction the foil-shaped part, which is only from approximately 15 to approximately 100 $\mu$m thick and has etched knife-edge rims, must be connected to a conductor extending into the interior of the lamp vessel and to a conductor extending from the pinched seal to the exterior, for which purpose welding connections must be made. The ohmic resistance of the foil-shaped part leads not only to electric losses, but also to a detrimental heat generation in the pinched seal. The current supply conductor, moreover, is a slack assembly, which can be manipulated only with difficulty during the manufacture of the lamp and which makes it difficult to position accurately in the lamp vessel that part which is to be located within said lamp vessel. The accuracy of positioning could be improved if the current supply conductor with a foil-shaped part could also within the lamp vessel be held and continuously positioned during the manufacture of a first pinched seal of the lamp vessel. A rigid current supply conductor would then have to be used for the manufacture of a second seal. Another disadvantage of lamps having a pinched seal is that the seal is destroyed at a comparatively low gas pressure of about 80 bar. In spite of these disadvantages, pinched seals are generally used in commercially available lamps. Short-arc discharge lamps are exceptions in this respect.

In short-arc discharge lamps, a construction is used in which a tungsten current supply conductor is sealed into glass having a comparatively high coefficient of expansion, which is connected via glasses having coefficients of expansion stepwise decreasing to the glass of the lamp vessel, which has a very low coefficient of expansion. This so-called "graded seal" obtained with the use of so-called "transition glasses" is expensive and can only be realized manually in most cases. Moreover, the construction occupies a large amount of space.

The construction having a foil-shaped part is used because glasses having an $SiO_2$ content of at least 95% by weight, such as, for example, quartz glass and "Vycor" glass, i.e. a glass containing 96% by weight of $SiO_2$, have a linear coefficient of expansion which is considerably smaller (in the range from about $4\times10^{-7}K^{-1}$ to about $12\times10^{-7}K^{-1}$) than that of molybdenum (about $55\times10^{-7}K^{-1}$). This great difference in coefficient of expansion and the great difference between the softening temperatures of the glasses and the operating temperature of the lamps on the one hand and room temperature on the other hand result in that molybdenum cannot be included in a vacuum-tight manner in these glasses without special steps being taken. Thanks to the foil shape, a vacuum-tight seal can be obtained with molybdenum owing to the ductility of this material in spite of the large difference in thermal expansion.

For several decades attempts have been made to devise special measures by which molybdenum current supply conductors in the form of wire or tube could be sealed into glasses, such as quartz glass. The result of these efforts is that commercially available lamps in such glasses still have either a pinched seal with an embedded metal foil or a graded seal with a tungsten current supply conductor.

The construction according to the aforementioned GB 602 215 is not used either. According to this Patent Specification, a molybdenum conductor is heated at its outer surface in an inert or reducing atmosphere by passage of an electric current or by a heat source inside the conductor, if the latter is hollow, after which it is provided with a quartz glass coating. It has been found difficult to realize the described construction in a reproducible manner. The reproducibility is found to be connected to the degree to which a coating, for example of quartz glass, can be obtained on the current supply conductors in a reproducible manner, which coating adheres to these conductors and encloses an angle $\alpha$ of max. 90° in order to prevent fractures of the coating.

U.S. Pat. No. 4,086,075 discloses a method of providing a vitreous coating on metal wires. The method consists in that a metal wire together with a glass tube tightly fitting around it is heated in a high-frequency field in a protective gas, such as nitrogen. The high-frequency field may be produced by a coil connected to a current source. A non-shortcircuited coil is present in the high-frequency field, which coil is heated, as is the metal wire, by the high-frequency field. They both heat the glass tube to its melting point. The coated wire is free from oxides and impurities have not been able to accumulate between the wire and the coating. The adhesion of a vitreous coating to a tungsten conductor apparently requires that the coating is provided on a tungsten conductor which is free from adsorbed gases, oxides and other impurities at its surface.

SUMMARY OF THE INVENTION

It is an object of the invention to provide an electric lamp of the kind mentioned in the opening paragraph which has a very simple construction and can be easily manufactured in a reproducible manner, and nevertheless has a great strength.

According to the invention, this object is achieved in that the glass of the coating adjoining the glass/metal interface contains an element chosen from the group consisting of thorium, hafnium, chromium, aluminum, titanium, tantalum, magnesium, calcium, strontium, barium, zirconium, lanthanum, scandium, lanthanides, niobium, boron and yttrium, and that the angle $\alpha$ is at most 90°.

It has been found that the presence of at least one of the just-mentioned elements in the layer of the glass coating that adjoins the glass/metal interface is a condition for obtaining a strong adhesion of the coating to the metallic surface of the current supply conductor and for obtaining an angle $\alpha$ of at most 90°. The presence of such an element in the coating can be demonstrated in a scanning electron microscope by means of energy dispersive analysis by x-rays.

The strength of the adhesion of the coating to the current supply conductor appears inter alia from the following experiments, during which the coating remained intact. Thorium is present in the glass of the quartz glass coating adjoining the glass/metal interface.

A spherical thickened quartz glass portion was provided by fusion of a quartz glass ring midway between the ends of a quartz glass coating of 10 mm length and 0.275 thickness on a molybdenum current supply conductor with 2% by weight $ThO_2$ and a diameter of 1 mm. The thickened portion had a diameter of 3 mm. The assembly was immersed in liquid nitrogen abruptly from an environment of room temperature.

A molybdenum current supply conductor with 1% by weight $Y_2O_3$ and a diameter of 1.34 mm had a quartz glass coating having a thickness of 0.290 mm. The conductor was heated to 800° C. by direct current passage in nitrogen, whereupon the wire was allowed to cool. After 2000 switching operations, the coating was fully intact. The coating had a length of 10 mm. The coating, surrounded by air, was heated at its centre by a plasma burner so strongly that the quartz glass evaporated substantially completely at that area. The coating was then still fully intact on either side of the heated area. Yttrium is present in the glass of the coating adjoining the glass/metal interface.

The lamp according to the invention can be obtained in simple manner. At least one coated current supply conductor is then sealed into a lamp vessel, for example, quartz glass. The coating on the current supply conductor may be obtained, for example, by applying a dispersion of at least one material chosen from thorium, hafnium, chromium, aluminum, titanium, tantalum, magnesium, calcium, strontium, barium, zirconium, lanthanum, scandium, lanthanides, niobium, boron and yttrium, a compound of one of these elements, such as an oxide, a salt, such as, for example, a nitrate, chloride, acetylacetonate, to a molybdenum wire, by heating the wire above the melting point of the glass, for example, to about 2200° C., and by fusing a glass, such as, for example, quartz glass, which is arranged to surround the wire, for example, like a tube, with the wire in a protective gas, such as, for example, nitrogen or a rare gas, or in vacuo. The elements diffuse into the coating during fusion.

It is also possible to start from a conductor of molybdenum containing one of the elements or containing an oxide by way of addition, for example a conductor of molybdenum containing a few %, for example 1 or 2% by weight, of $ThO_2$ or $Y_2O_3$. In this case, the element or oxide can be brought to the surface of a conductor by oxidizing the conductor at elevated temperature, for example at 600° C. or higher, for example at about 1200° C., for example by exposing it to air at elevated temperature, and by then heating it in a protective gas, such as a rare gas or nitrogen, or in vacuo to a temperature above 1800° C., for example to about 2000° C. molybdenum oxides then evaporate and the element is left as such or in oxidic form at the surface. The conductor is then provided with a coating of, for example, quartz glass, for example by heating the conductor enveloped by a quartz glass tube in a high-frequency field. This method of applying has been described above in connection with U.S. Pat. No. 4,086,075. Instead of a non-shortcircuited coil, however, a ring may be used in the high-frequency field. It is of essential importance to prevent molybdenum oxides being present during the application of the coating.

If in this manufacturing method a coating must be provided on a comparatively thin conductor having, for example, a diameter of 0.2 mm, it is recommendable to use a glass tube having a small wall thickness of, for example, 0.1 mm. With the use of a tube having a comparatively large wall thickness, the inner side of this tube would not be heated to a sufficiently high temperature by the comparatively thin conductor by means of irradiation. It may then be recommendable to supply heat to the conductor also by direct current passage or by means of a laser.

Alternatively, a thin coating may be provided first in a high-frequency field in an environment of rare gas or nitrogen which can be readily maintained with the use of this heat source, possibly in a slightly reducing environment by the addition of a few to a few tenths of % by volume of hydrogen, or in vacuo, and then a thickened portion may locally be formed, for example, by means of a burner on this coating. For this purpose, a glass tube may be slipped around the coating and be fused with the coating, for example, by heating with a flame.

A comparatively thick coating or a local thickening of the coating may be of importance for readily processing the coated conductor into a portion of a lamp.

It is a surprise to find that it is of minor importance for the stability and the quality of the lamp whether the coating of the conductor is thin. It has been found that comparatively very thick coatings also adhere excellently to the conductor and have only very small mechanical stresses. It has further been found that coatings on comparatively very thick conductors are of high quality and very durable.

The angle $\alpha$ between the surface of the glass coating and the coated surface of the current supply conductor at the point at which they meet is at most 90°, but is generally smaller in the lamp according to the invention due to the fact that the glass suitably wets the metal. This is the condition for avoiding tensile stresses at the surface. The material present on the surface of the current supply conductor during the manufacture of the lamp influences the wetting of the conductor by the glass and, as already demonstrated, the adhesion of the glass to the conductor, not in an unfavourable, but in a favourable sense.

The electric element of the lamp according to the invention may be a pair of electrodes, possibly surrounded by an inner envelope. The pair of electrodes may be constituted by the inner free ends of the current supply conductors. The inner free ends may have, for example, a thickened portion or a wrapped part or an electrode head may be fixed thereto. The electric element may alternatively be an incandescent body, for example a filament in a halogen-containing gas mixture.

The current supply conductors generally have a thickness in the range of 0.2 to 0.7 mm, but smaller thicknesses of, for example, 0.17 mm, for example with discharge lamps of low power, for example about 35 W, or larger thicknesses, for example 2 mm, for example with short-arc discharge lamps, may be used. In general, current supply conductors will have a thickness in the range of 0.4 to 0.7 mm.

Current supply conductors having a diameter of 0.55 mm were provided with a coating of glass having an $SiO_2$ content of at least 95% by weight by each of the following methods in order to render them suitable for sealing into a lamp vessel consisting of such a glass. Very satisfactorily adhering coatings were then obtained, which satisfy stringent requirements.

A wire of molybdenum containing 2% by weight of $ThO_2$ distributed therein was heated to 1300° C. and exposed to the air. The molybdenum oxide then formed was subsequently evaporated at about 1800° C. in an inert environment, for example in nitrogen. After a molybdenum skin had been removed in this manner, $ThO_2$ was left at the surface. A tube of quartz glass having a length of 15 mm and a wall thickness of 0.275 mm was fused with the wire. Thorium was found by means of energy dispersive analysis by x-rays in the glass adjoining the glass/metal interface.

By the use of a suspension of 10 mg of an oxide of thorium, hafnium, chromium, aluminum, titanium, tantalum, magnesium, calcium, strontium, barium, zirconium, lanthanum, scandium, a lanthanide, niobium, boron or yttrium in, for example, 0.5 ml of butyl acetate, a quartz glass coating was obtained in an analogous manner on such a molybdenum wire, in which the metal of the oxide in question was demonstrated to be in the glass adjoining the glass/metal interface.

BRIEF DESCRIPTION OF THE DRAWING

Embodiments of the lamp according to the invention is shown in the drawing.

In the drawing.

DESCRIPTION OF THE PREFERRED EMBODIMENTS

Figure 1:
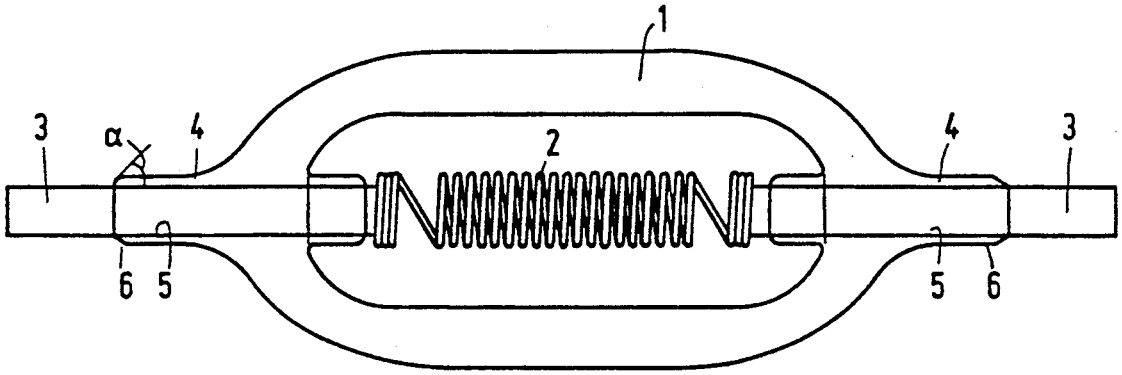
FIG. 1 is a side elevation of an incandescent lamp.

In FIG. 1, the electric incandescent lamp has a lamp vessel 1 sealed in a vacuum-tight manner and consisting of glass having an $SiO_2$ content of at least 95% by weight. A tungsten incandescent body 2 is arranged in the lamp vessel 1 as an electric element. Current supply conductors 3 mainly consisting of molybdenum extend opposite to each other through the wall of the lamp vessel 1 to the filament 2. Respective circumferential coatings 4 of glass having an $SiO_2$ content of at least 95% by weight are disposed on the current supply conductors 3. The coating 4 extends from the exterior of the lamp vessel 1 to the interior of the lamp vessel and is fused thereto. The coating 4 forms with the current supply conductor a glass/metal interface 5. The surface 6 of the coating 4 and the coated surface of the current supply conductors 3, i.e. the glass/metal interface 5, enclose at the area at which they meet an angle $\alpha$ of at most 90°. The glass of the coating 4 adjoining the glass/metal interface contains an element chosen from the group consisting of thorium, hafnium, chromium, aluminum, titanium, tantalum, magnesium, calcium, strontium, barium, zirconium, lanthanum, scandium, lanthanides, niobium, boron and yttrium.

In the lamp shown, the lamp vessel 1 and the coatings 4 consist of quartz glass.

The current supply conductors 3 comprise molybdenum containing 1% by weight of yttrium oxide and have a diameter of 1.34 mm. They are provided with a coating 4 having a thickness of 0.275 mm. The glass of the coating 4 adjoining the glass/metal interface contains yttrium. The current supply conductors 3 are connected to the incandescent body 2.

In another embodiment molybdenum current supply conductors of 0.65 mm diameter are used, which had been immersed in a suspension of 10 mg of $Cr_2O_3$ in 10 ml of water and, after drying, had been provided with a quartz glass coating of 0.1 mm thickness. The glass of this coating adjoining the glass/metal interface contains chromium. In yet other embodiments, boron oxide and aluminum oxide, respectively, were used.

Figure 2:
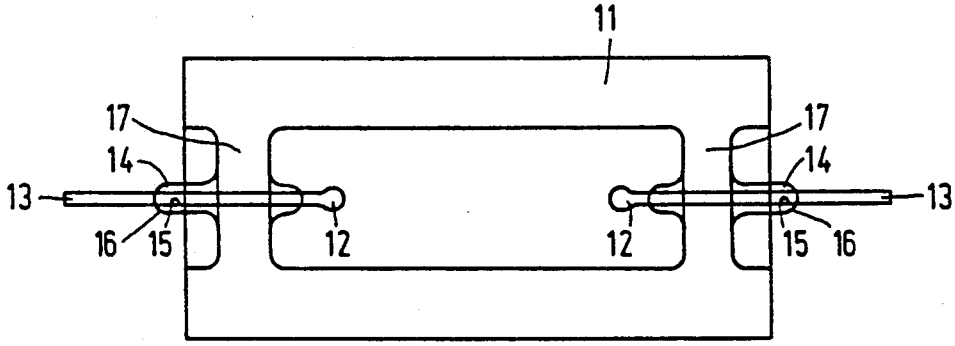
FIG. 2 is a side elevation of a discharge lamp.

In FIG. 2, parts corresponding to parts of FIG. 1 have reference numerals which are 10 higher.

The current supply conductors 13 consist of molybdenum containing 1% by weight of thorium oxide and have a diameter of 0.25 mm with a tungsten electrode 12 in the lamp vessel 11. The electrodes 12 as a pair of electrodes constitute an electric element. Thorium is present in the quartz glass coatings 14. The coatings 14 have a thickness of 0.125 mm, while a quartz glass ring 17 is provided thereon and fused thereto. The lamp vessel 11 has an inner length of 7.8 mm and an inner diameter of 2.7 mm. The lamp vessel 11 is filled to a pressure of 6 bar with xenon (at 300K), 0.6 mg of mercury and 0.4 mg of an $NaI/ScI_3/TlI/ThI_4$ mixture. The lamp consumes a power of 35 W at a voltage of 85 V and may be used, for example, as a light source in a motor vehicle head-light.

We claim:

1. An electric lamp comprising:

a lamp vessel sealed in a vacuum-tight manner and consisting of glass having an $SiO_2$ content of at least 95% by weight, an electric element arranged inside the lamp vessel, current supply conductors extending through the wall of the lamp vessel to the electric element, at least one current supply conductor made of molybdenum with a continuous coating of glass having a $SiO_2$ content of at least 95% by weight, which coating forms with the current supply conductor a glass/metal interface and is fused to the lamp vessel, while the surface of the coating encloses with the coated surface of the current supply conductor at the points at which they meet an angle $\alpha$, characterized in that the glass of the coating adjoining the glass/metal interface contains an element chosen from the group consisting of thorium, hafnium, chromium, aluminum, titanium, tantalum, magnesium, calcium, strontium, barium, zirconium, lanthanum, scandium, lanthanides, niobium, boron and yttrium, and that the angle $\alpha$ is at most 90°.

2. An electric lamp as claimed in claim 1, characterized in that the chosen element is also distributed in the current supply conductor.

3. An electric lamp as claimed in claim 2, characterized in that the chosen element is yttrium.

4. An electric lamp as claimed in claim 1, characterized in that the current supply conductor is substantially free from the chosen element.

5. An electric lamp as claimed in claim 4, characterized in that the chosen element is yttrium.

6. An electric lamp as claimed in claim 4, characterized in that the chosen element is boron.

7. An electric lamp as claimed in claim 4, characterized in that the chosen element is chromium.

* * * * *